US007967631B2

(12) United States Patent
Wang et al.

(10) Patent No.: US 7,967,631 B2
(45) Date of Patent: Jun. 28, 2011

(54) STACKED ELECTRICAL CONNECTOR WITH IMPROVED INSULATORS

(75) Inventors: Li-Jiang Wang, Kunshan (CN); Jia-Yong He, Kunshan (CN); Zhong-Hua Yao, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 192 days.

(21) Appl. No.: 12/479,870

(22) Filed: Jun. 8, 2009

(65) Prior Publication Data

US 2009/0305555 A1 Dec. 10, 2009

(30) Foreign Application Priority Data

Jun. 6, 2008 (CN) ..... 2008 2 0038044
Aug. 5, 2008 (CN) ..... 2008 2 0041570

(51) Int. Cl.
*H01R 13/60* (2006.01)

(52) U.S. Cl. ..... 439/541.5; 439/607.23

(58) Field of Classification Search ..... 439/79, 439/541.5, 607.23, 607.27, 607.35, 607.55, 439/701
See application file for complete search history.

(56) References Cited

U.S. PATENT DOCUMENTS

| | | | | |
|---|---|---|---|---|
| 6,139,367 | A | 10/2000 | Yeh | |
| 6,149,459 | A * | 11/2000 | Yang | 439/541.5 |
| 6,155,872 | A | 12/2000 | Wu | |
| 6,520,799 | B1 | 2/2003 | Cheng et al. | |
| 6,524,130 | B1 | 2/2003 | Yeh | |
| 6,540,563 | B1 * | 4/2003 | Hu et al. | 439/676 |
| 7,008,762 | B2 * | 3/2006 | Zhang et al. | 439/541.5 |
| 7,364,463 | B1 * | 4/2008 | Ju | 439/607.55 |
| 7,410,391 | B2 * | 8/2008 | Wan et al. | 439/607.01 |
| 7,556,528 | B1 * | 7/2009 | Ju | 439/541.5 |

FOREIGN PATENT DOCUMENTS

TW M323149 12/2007

* cited by examiner

*Primary Examiner* — Thanh-Tam T Le
(74) *Attorney, Agent, or Firm* — Wei Te Chung; Andrew C. Cheng; Ming Chieh Chang

(57) ABSTRACT

A stacked electrical connector includes a first insulator and a second insulator mounted together. The first insulator includes a first connector and a receiving opening under a bottom wall of the first connector. The second insulator includes a second connector and a top wall. The bottom wall of the first connector includes a first retention member and the top wall of the second insulator defines a second retention member for mating with the first retention member. The first retention member is a protrusion or a dovetail shaped recess, and the second retention member is a rest of the protrusion or the dovetail shaped recess. The protrusion has an upper narrow section and a lower wide section under a condition that when the protrusion is received in the dovetail shaped recess, a movement therebetween can be prevented.

12 Claims, 15 Drawing Sheets

STACKED ELECTRICAL CONNECTOR WITH IMPROVED INSULATORS

BACKGROUND OF THE INVENTION

1. Field of the Invention

This invention generally relates to an electrical connector, and more particularly to a stacked electrical connector with improved insulators for stably retention.

2. Description of Related Art

Multi-port connectors are popular for achieving compact size compared with simple stacks of several single-port connectors. U.S. Pat. No. 6,139,367 discloses a traditional stacked electrical connector including an integral insulative housing, a plurality of contacts retained in the insulative housing and a metal shell enclosing the insulative housing. Each port includes a tongue plate mounted with the corresponding contacts. However, with rapid development of electronic devices, more and more new ports appear. Under this condition, how to combine the new ports with the traditional connector ports with lower cost and stable structure becomes a problem. As mentioned above, since the multi ports jointly share the insulative housing, the stacked electrical connector can be easily modified to expand other ports such as the new ports.

Hence, it is desired to have a stacked electrical connector with improved insulators solving the problems above.

BRIEF SUMMARY OF THE INVENTION

A stacked electrical connector includes a first insulator and a second insulator mounted together. The first insulator includes a vertical rear plate and a first connector extending forwardly from a top side of the rear plate in order to form a receiving opening formed by the rear plate and a bottom wall of the first connector. The second insulator includes a second connector located under the first connector. The second insulator includes a top wall and a pair of side walls. Each side wall is layer shaped and comprises an outer layer and an inner layer which is contracted compared with the out layer along a transverse direction. The second insulator is assembled to the first insulator along a front-to-rear direction perpendicular to the transverse direction with the inner layers received in the receiving opening. The bottom wall of the first connector includes a first retention member and the top wall of the second insulator defines a second retention member for mating with the first retention member. The first retention member is a protrusion or a dovetail shaped recess, and the second retention member is a rest of the protrusion or the dovetail shaped recess under a condition that the protrusion has an upper narrow section and a lower wide section so that, when the protrusion is received in the dovetail shaped recess, a movement between the protrusion and the dovetail shaped recess along a vertical direction can be prevented.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
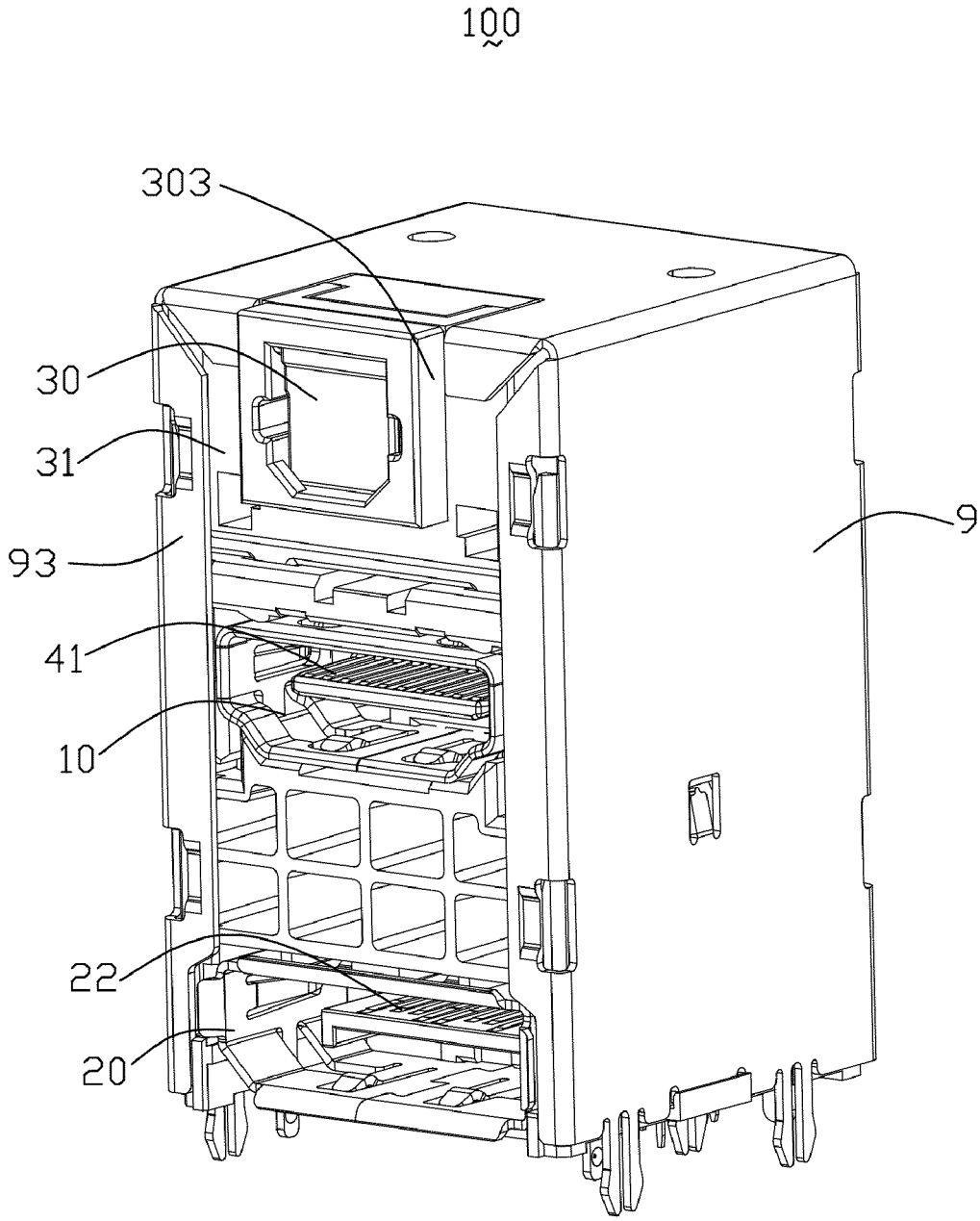
FIG. 1 is a perspective view of a stacked electrical connector according to a first embodiment of the present invention.
Figure 2:
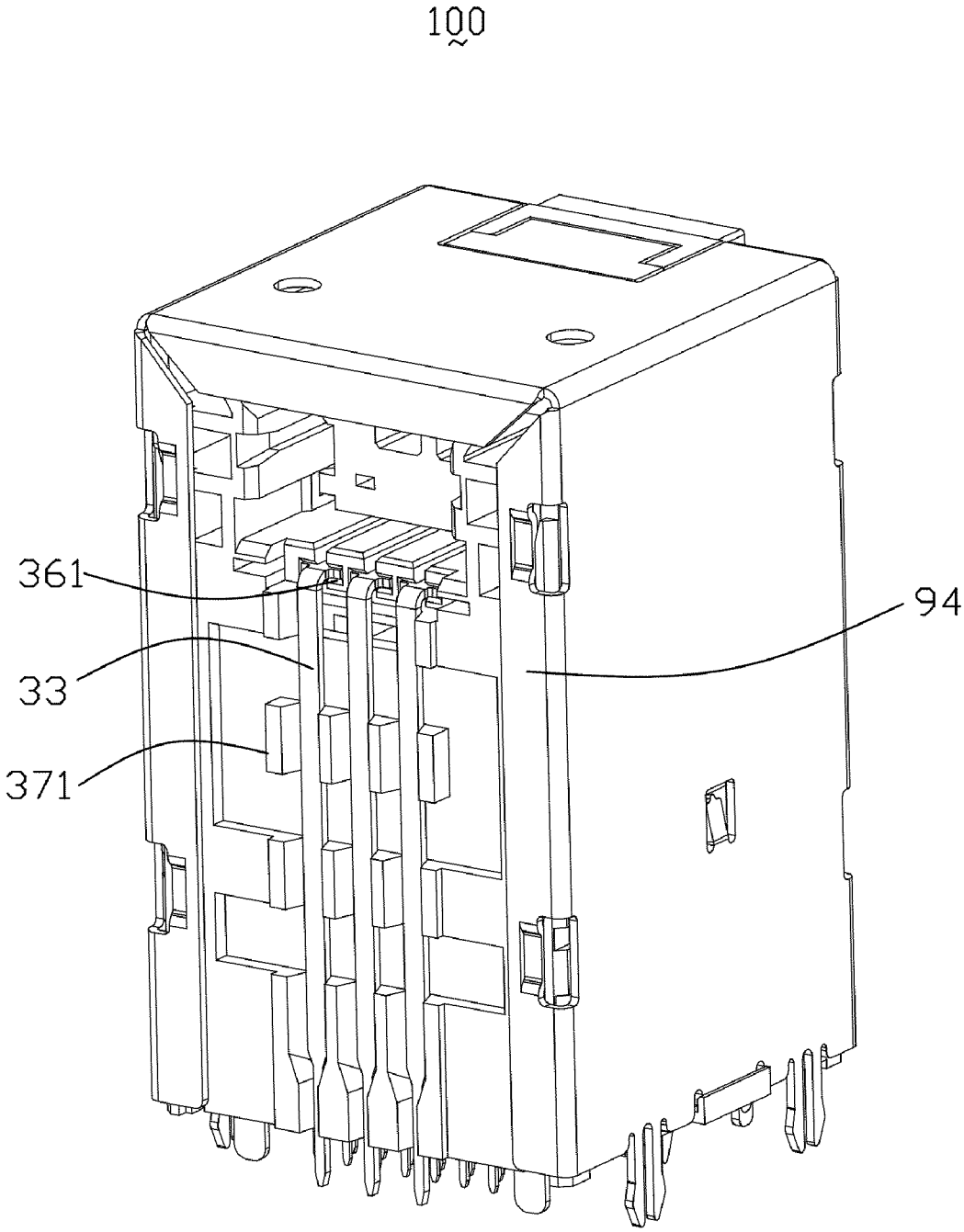
FIG. 2 is another perspective view of the stacked electrical connector, but viewed from another aspect.
Figure 3:
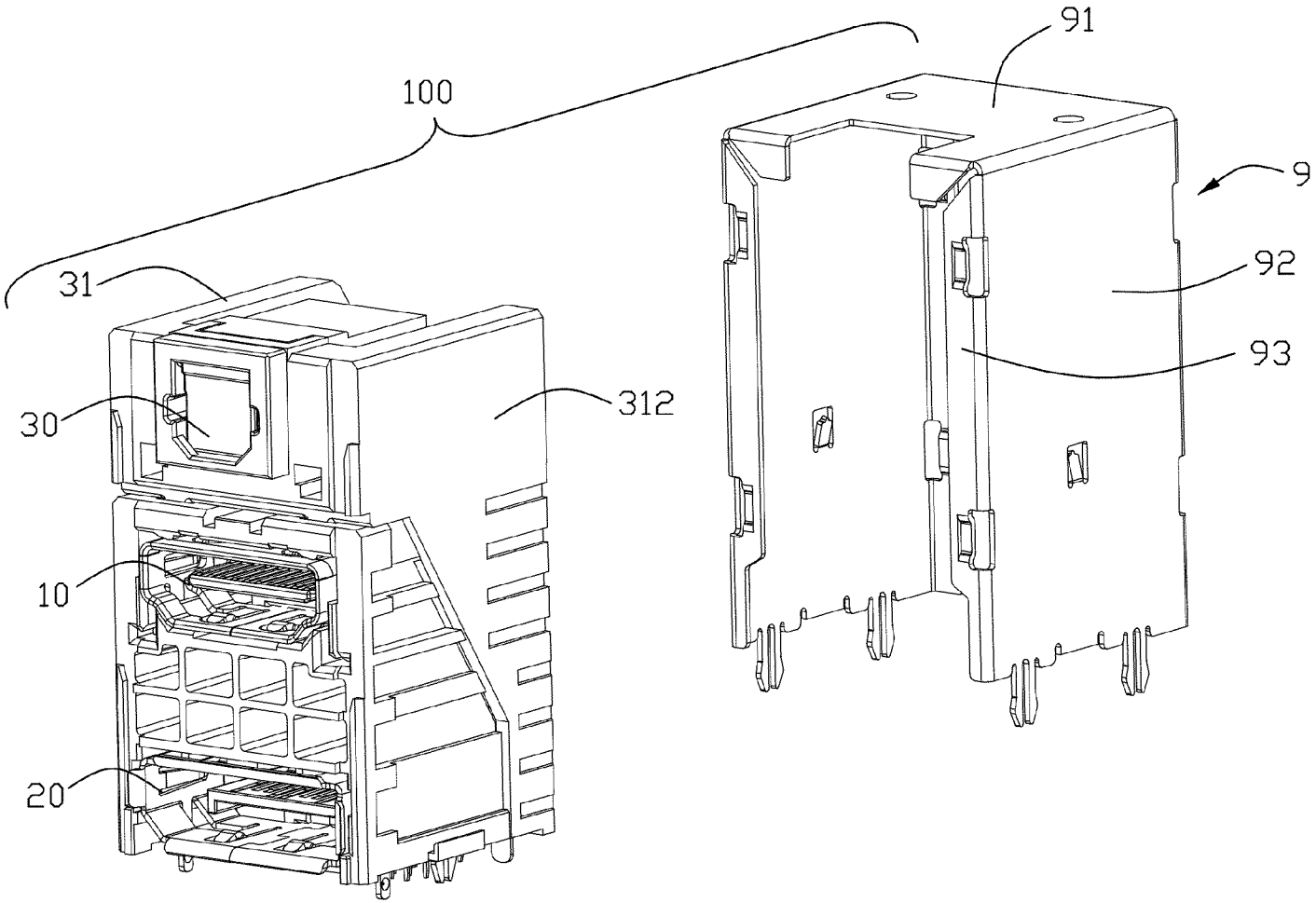
FIG. 3 is a part exploded view of the stacked electrical connector with an out metal shell apart therefrom.
Figure 4:
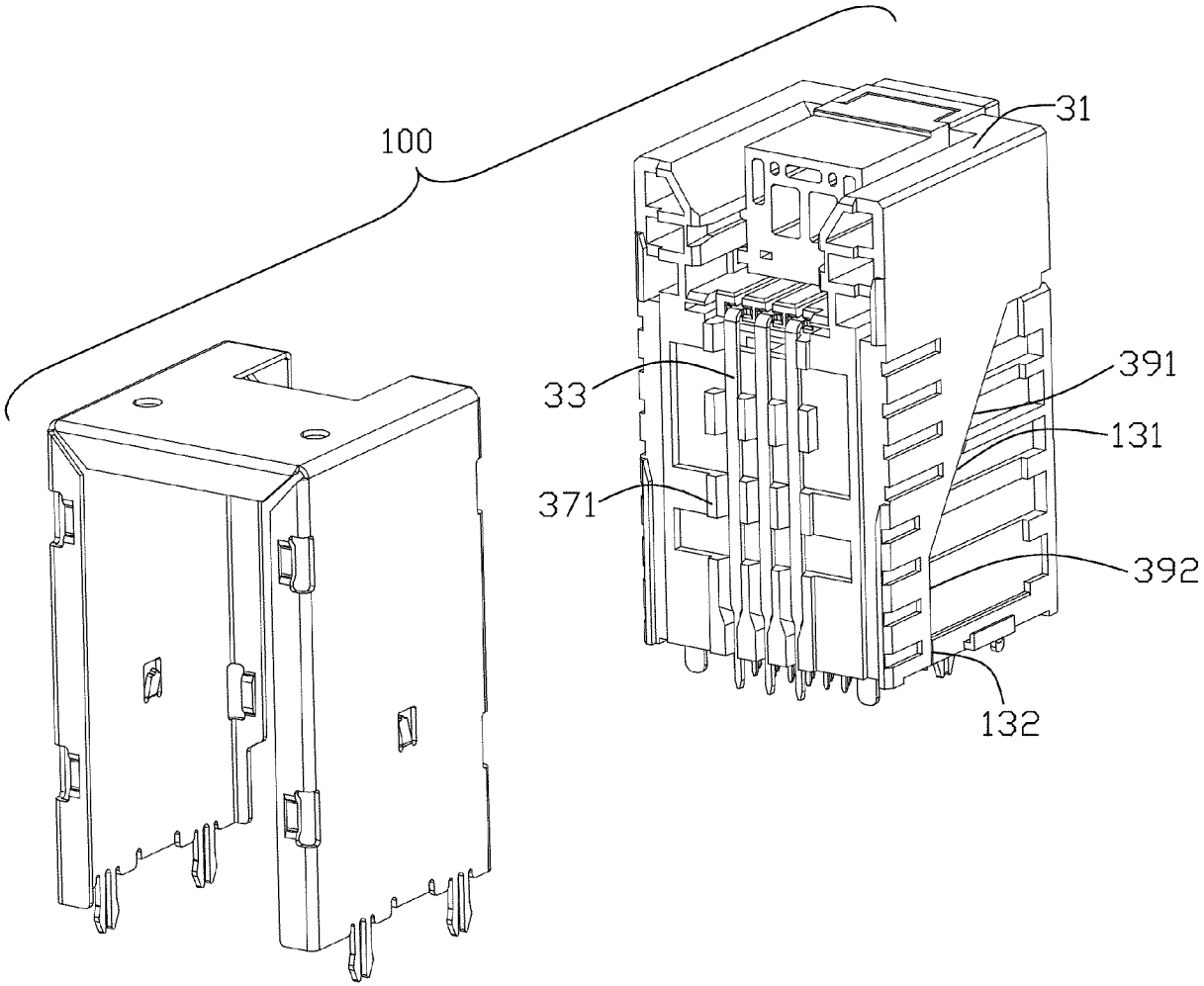
FIG. 4 is another part exploded view shown in FIG. 3, but viewed from another aspect.
Figure 5:
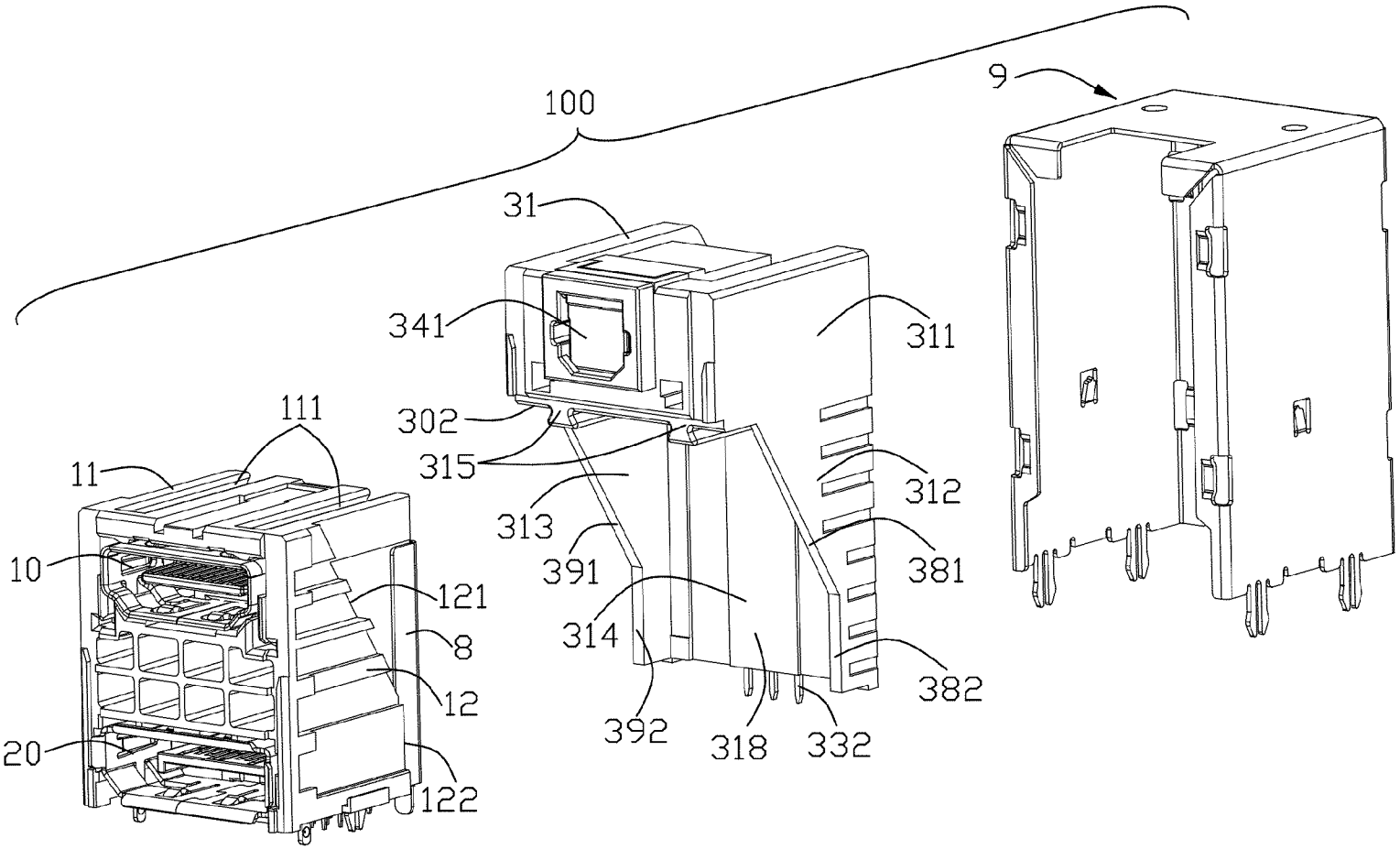
FIG. 5 is a part exploded view showing a first insulator and a second insulator separated with each other.
Figure 6:
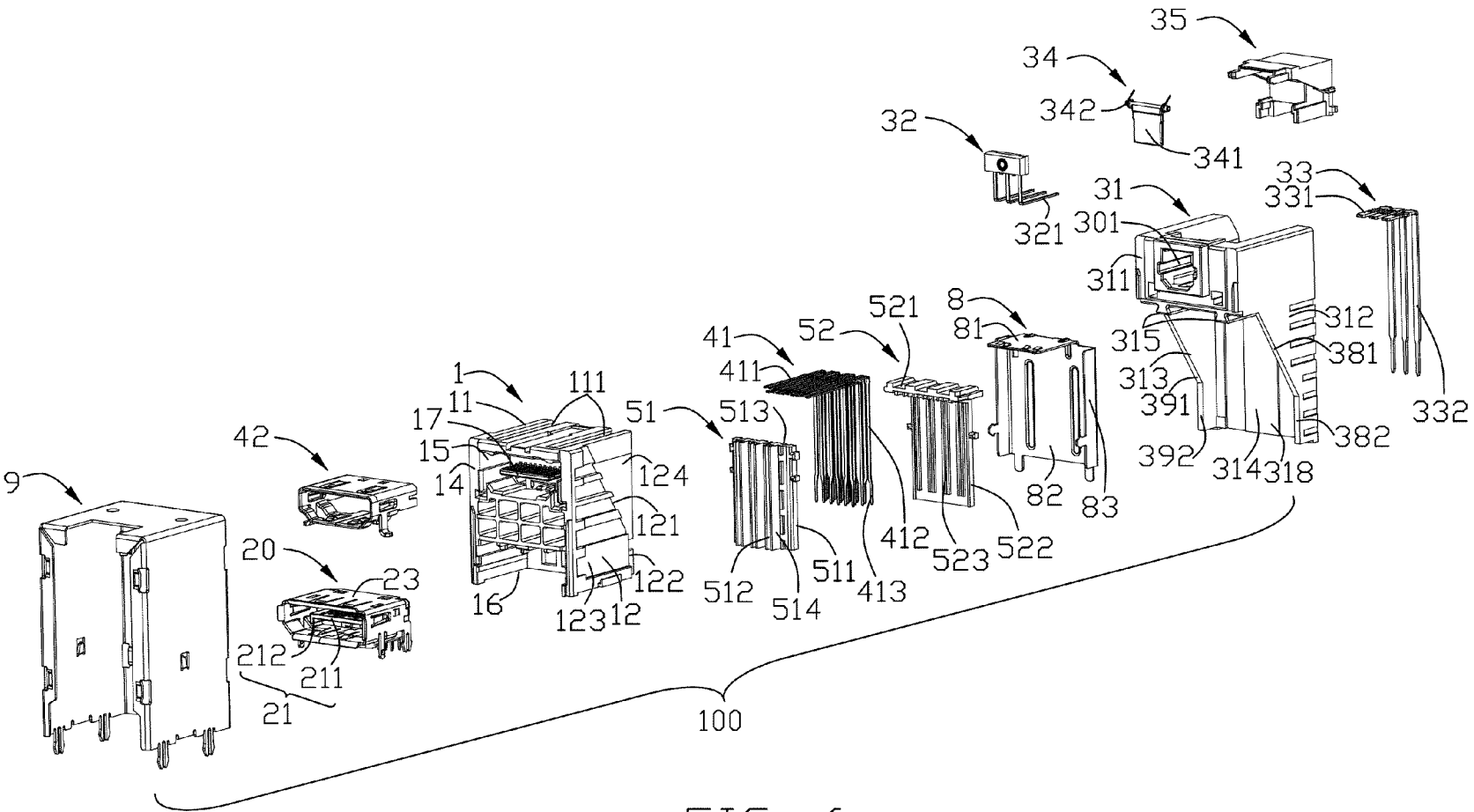
FIG. 6 is an exploded view of the stacked electrical connector.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1 to 5, a stacked electrical connector 100 according to a first embodiment of present invention is disclosed. The stacked electrical connector 100 includes a first insulator 31 formed with a first connector 30 and a second insulator 1 formed with a second connector 10. A preload third connector 20 is received in second insulator 1 and located below the second connector 10.

Referring to FIGS. 6 to 9, the first insulator 31 includes a base 311, a pair of first and second side walls 312, 313 extending forwardly from lateral sides of the base 311, a receiving opening 314 formed between the side walls 312, 313 and a vertical rear plate 318 located at a rear side of receiving opening 314. The side walls 312, 313 include slant first engaging walls 381, 391 and vertical second engaging walls 382, 392. The rear plate 318 includes a plurality of blocks 371 and a plurality of slots 361 formed by the adjacent two blocks 371. The first connector 30 forwardly extends beyond the rear plate 318 and includes a first receiving space 301, an optical member 32 received in the first receiving space 301, a plurality of first contacts 33 electrically connecting the optical member 32, a rotatable door member 34 for shielding the optical member 32 and a rear cover 35 covering the optical member 32 for protection. The optical member 32 includes a plurality of pressing tails 321. The first contacts 33 include a plurality of horizontal mating sections 331 abutting against the pressing tails 321 and a plurality of retaining sections 332 perpendicular to the mating sections 331. The retaining sections 332 are retained in the corresponding slots 361. The door member 34 includes a pivotal door 341 and a pair of torsion springs 342 for abutting against the pivotal door 341 in order to provide recovery force. The first connector 30 includes a bottom wall 302 upwardly limiting the receiving opening 314. The bottom wall 302 includes a pair of dovetail shaped protrusions 315 extending downwardly into the first receiving space 301. Each dovetail shaped protrusion 315 has an upper narrow section 316 and a lower wide section 317. A frame portion 303 is formed on the first connector 30 to forwardly extend beyond a front surface 14 of the second insulator 1. The first receiving space 301 is defined through the frame portion 303 for accommodating a corresponding optical plug (not shown).

Figure 7:
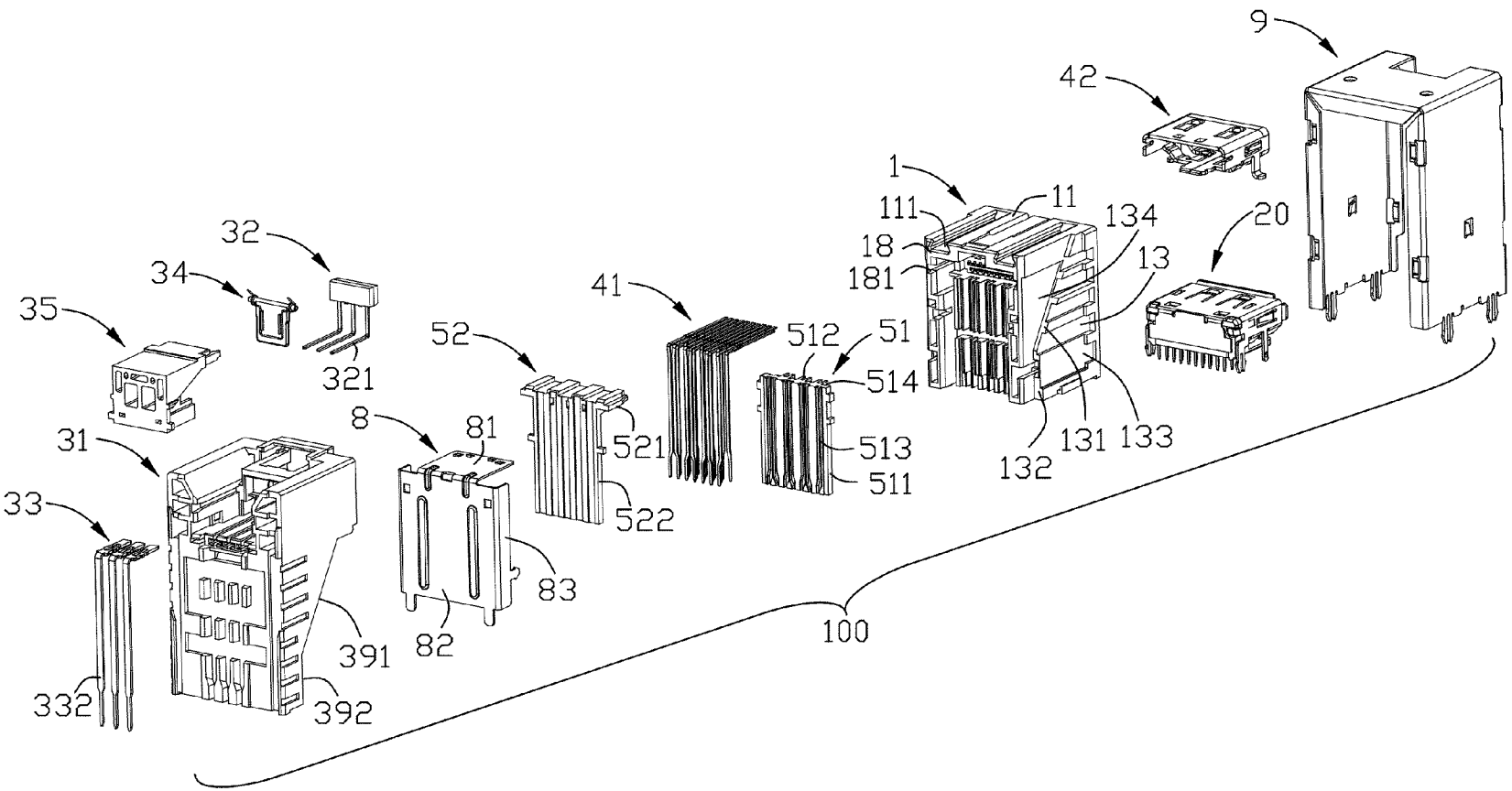
FIG. 7 is another exploded view of the stacked electrical connector similar to FIG. 6, while taken from another aspect.
Figure 8:
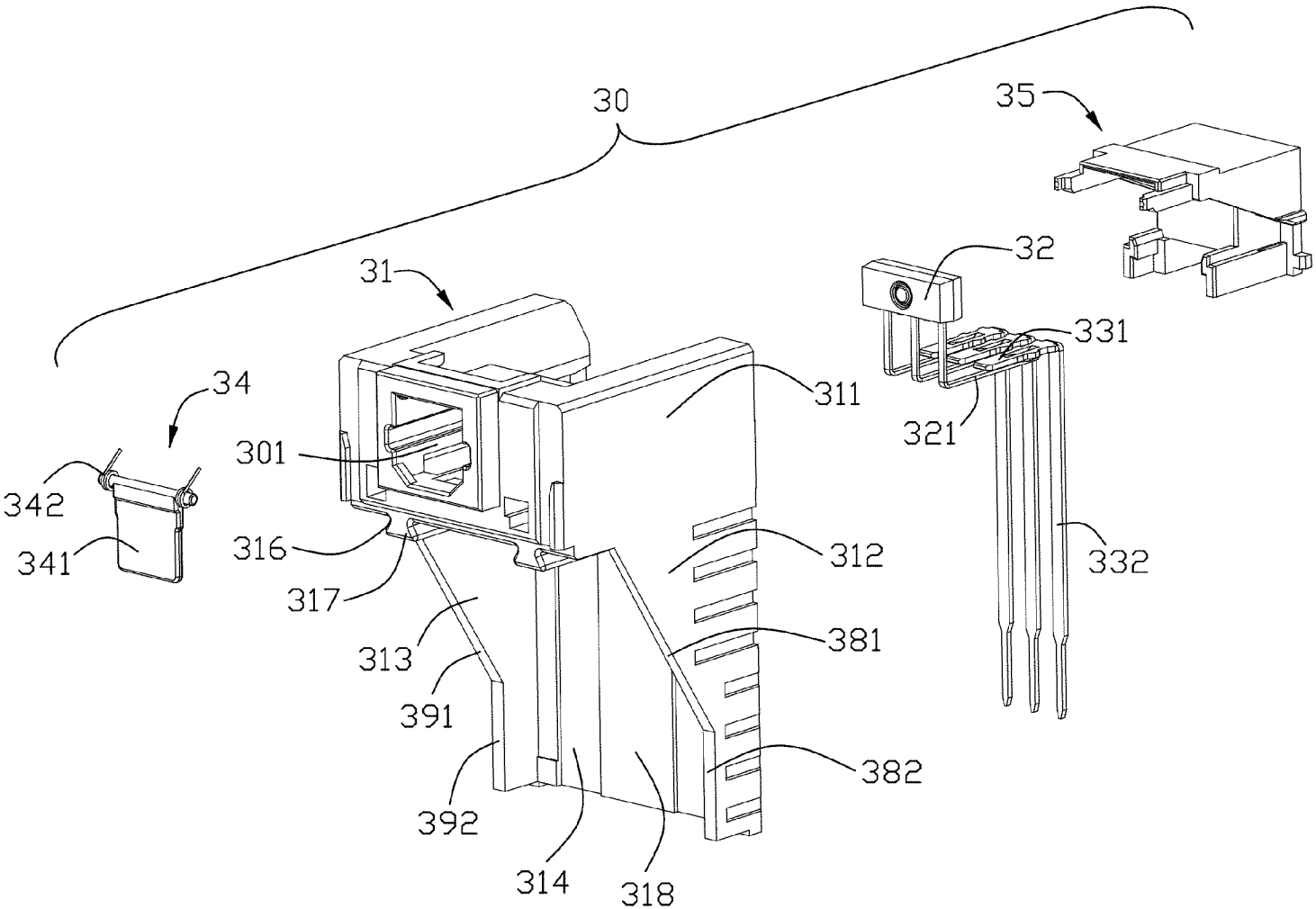
FIG. 8 is a perspective view of the first insulator shown in FIG. 5.
Figure 9:
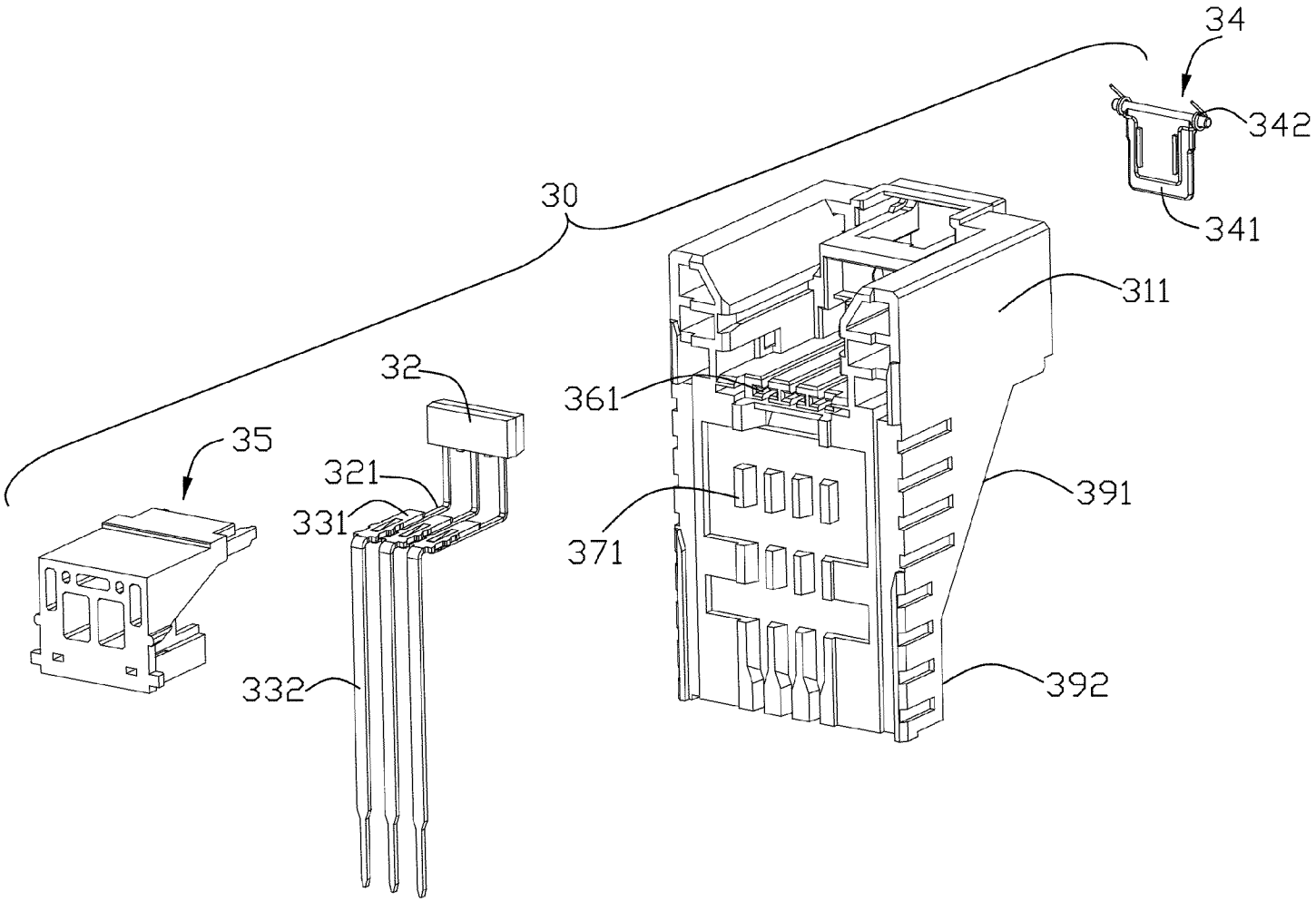
FIG. 9 is another perspective view of the first insulator similar to FIG. 8, while taken from another aspect.
Figure 10:
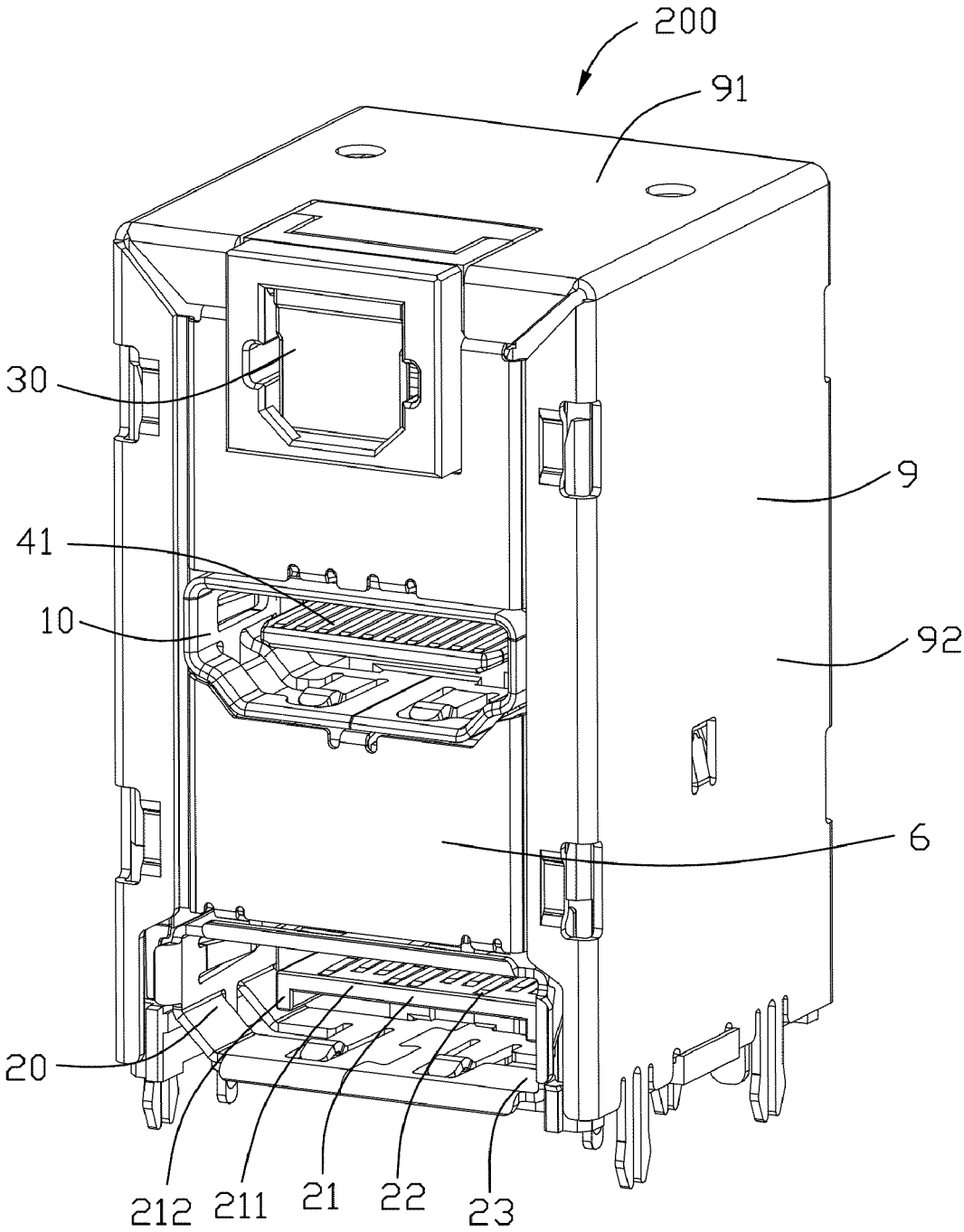
FIG. 10 is a perspective view of another stacked electrical connector according to a second embodiment of the present invention.
Figure 11:
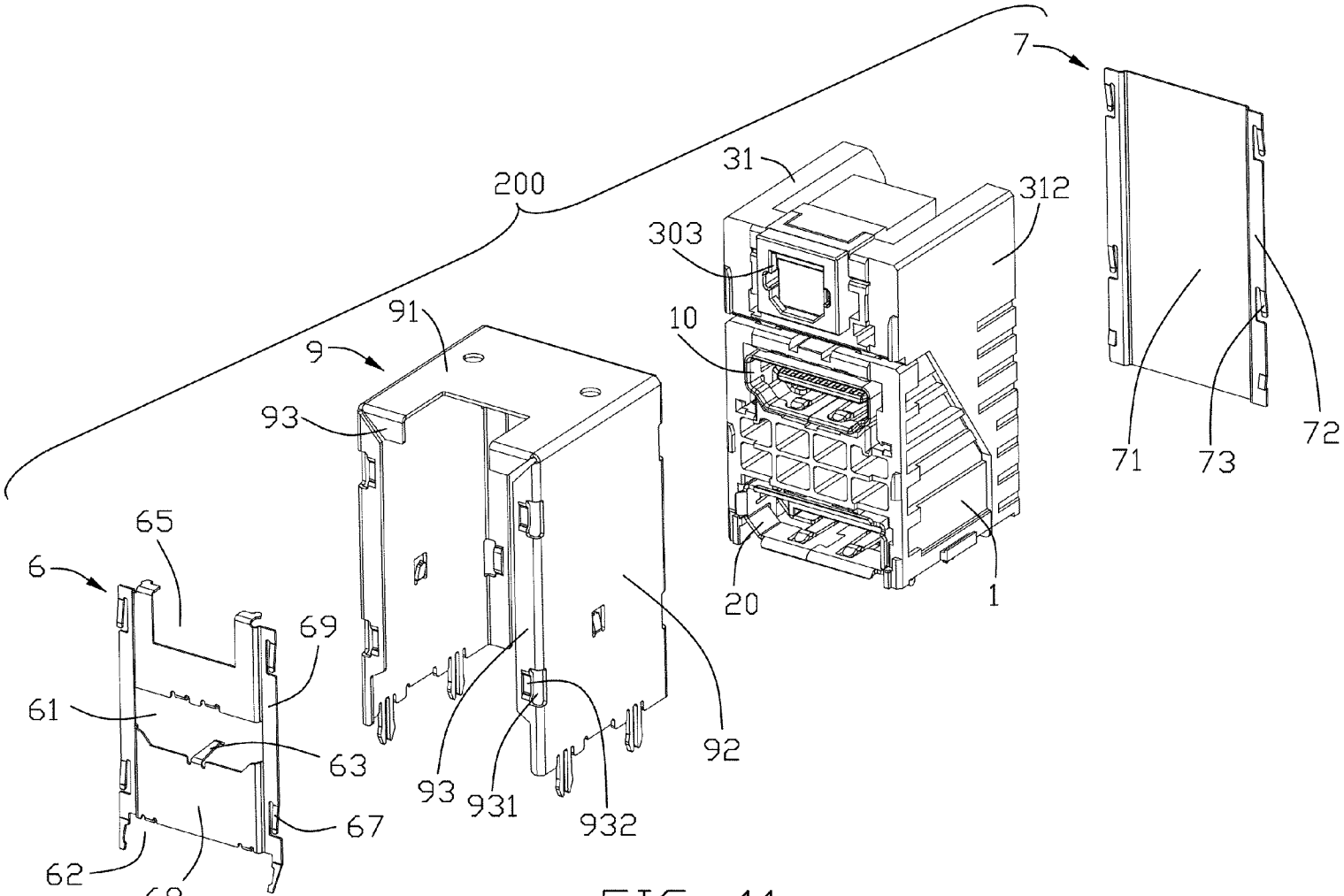
FIG. 11 is a part exploded view of the stacked electrical connector shown in FIG. 10 with a front metal piece, a rear metal piece and an out metal shell apart therefrom.
Figure 12:
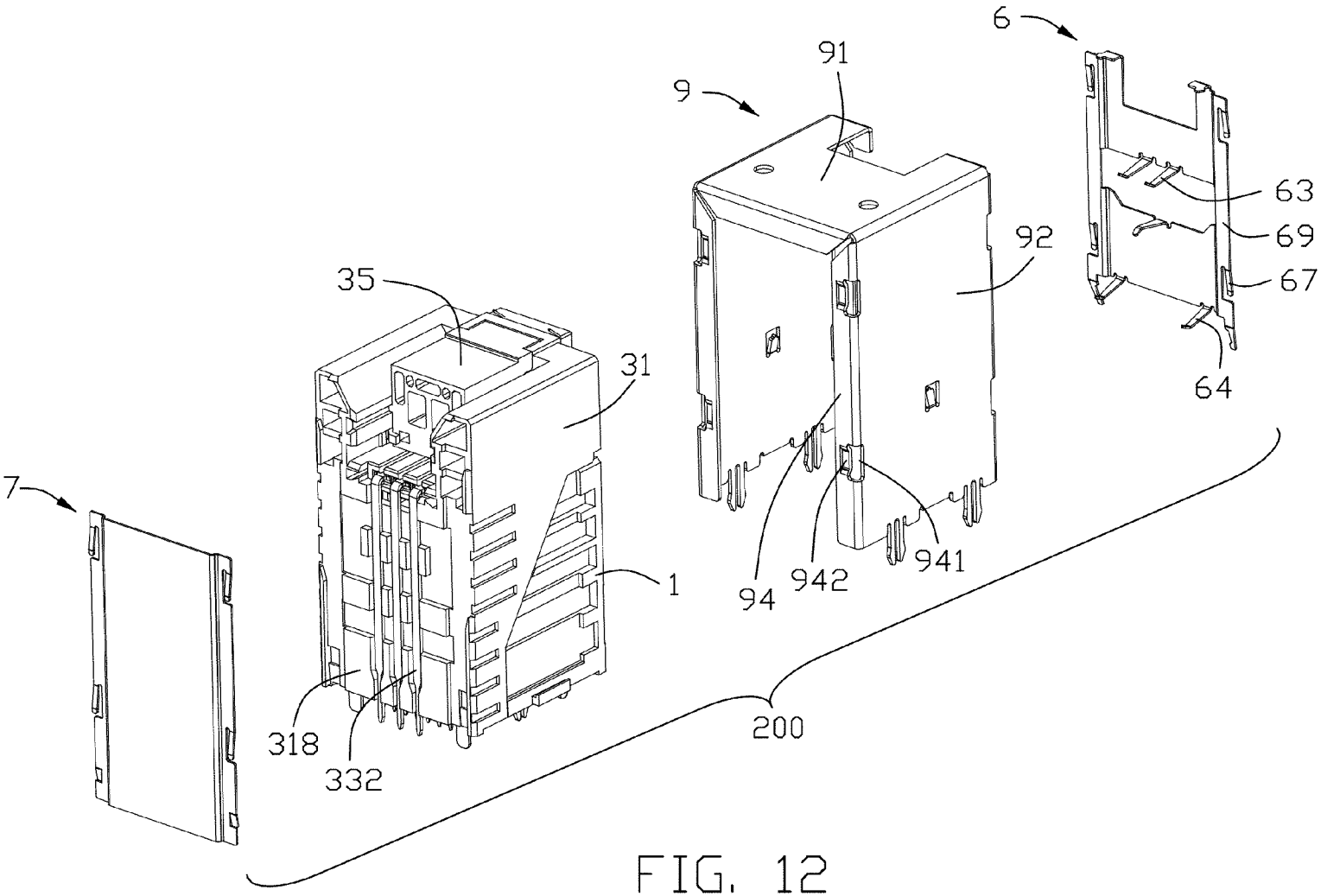
FIG. 12 is another part exploded view shown in FIG. 11, but viewed from another aspect.
Figure 13:
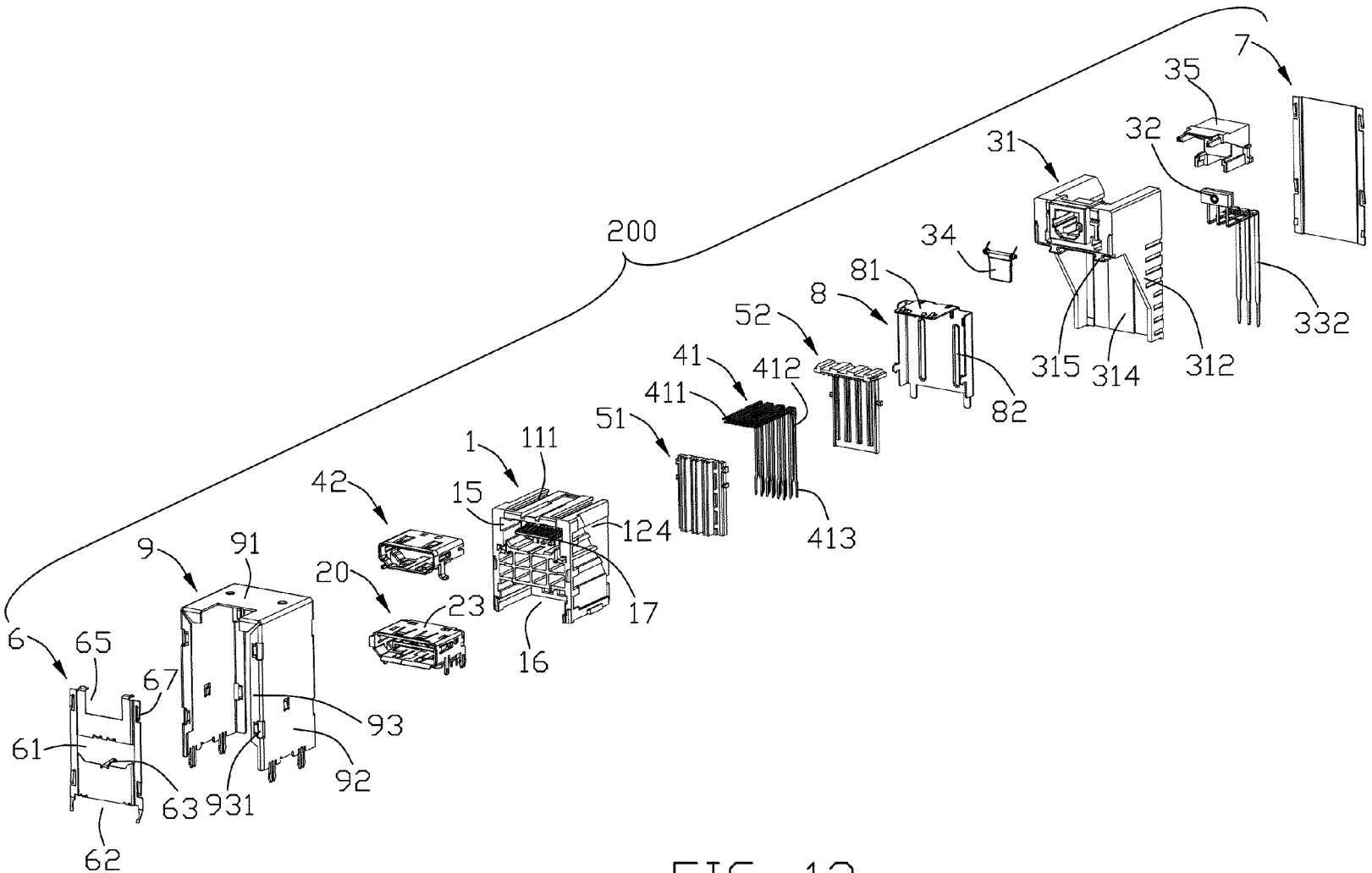
FIG. 13 is an exploded view of the stacked electrical connector according to the second embodiment.
Figure 14:
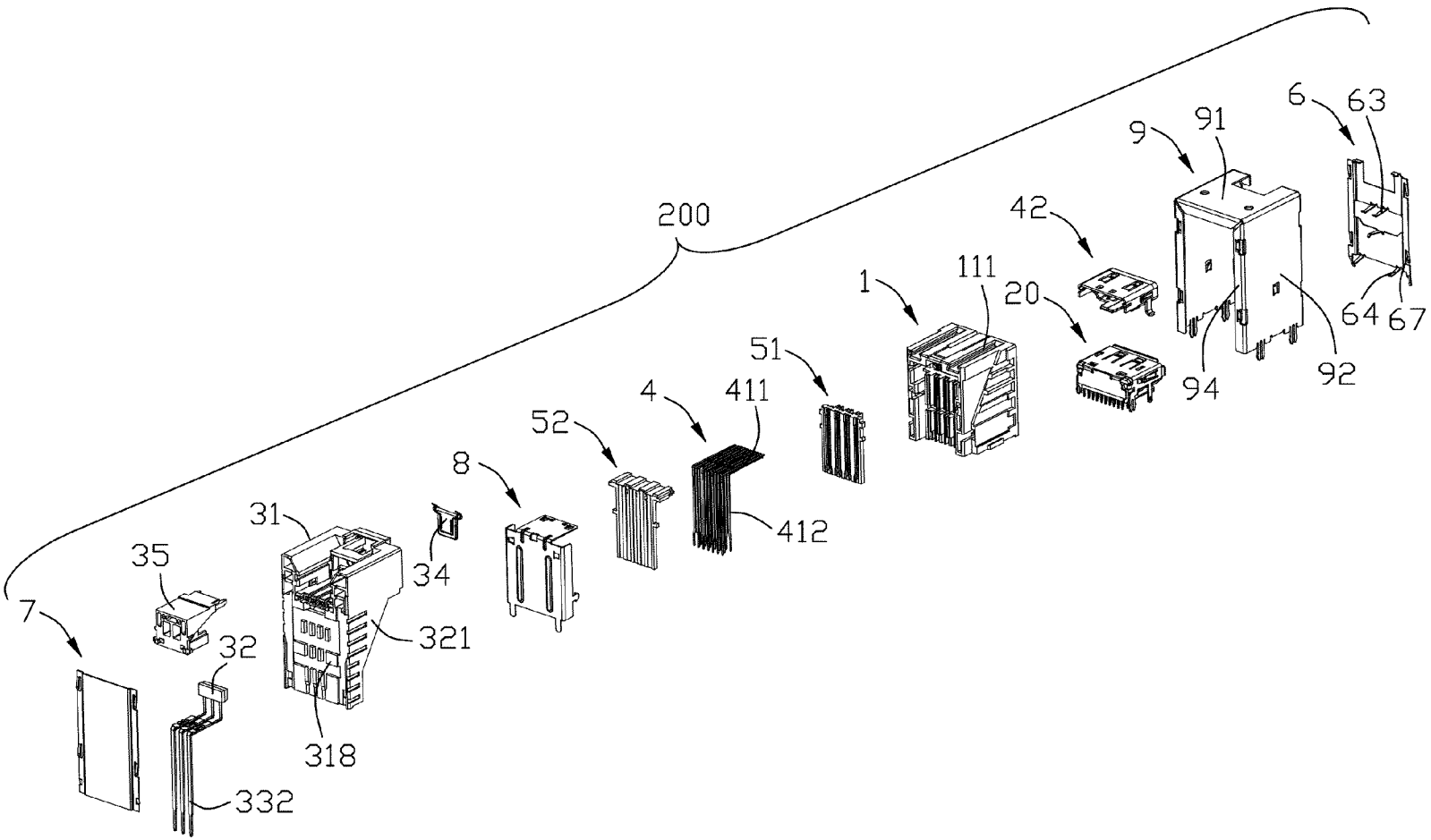
FIG. 14 is another exploded view of the stacked electrical connector shown in FIG. 13, while taken from another aspect.
Figure 15:
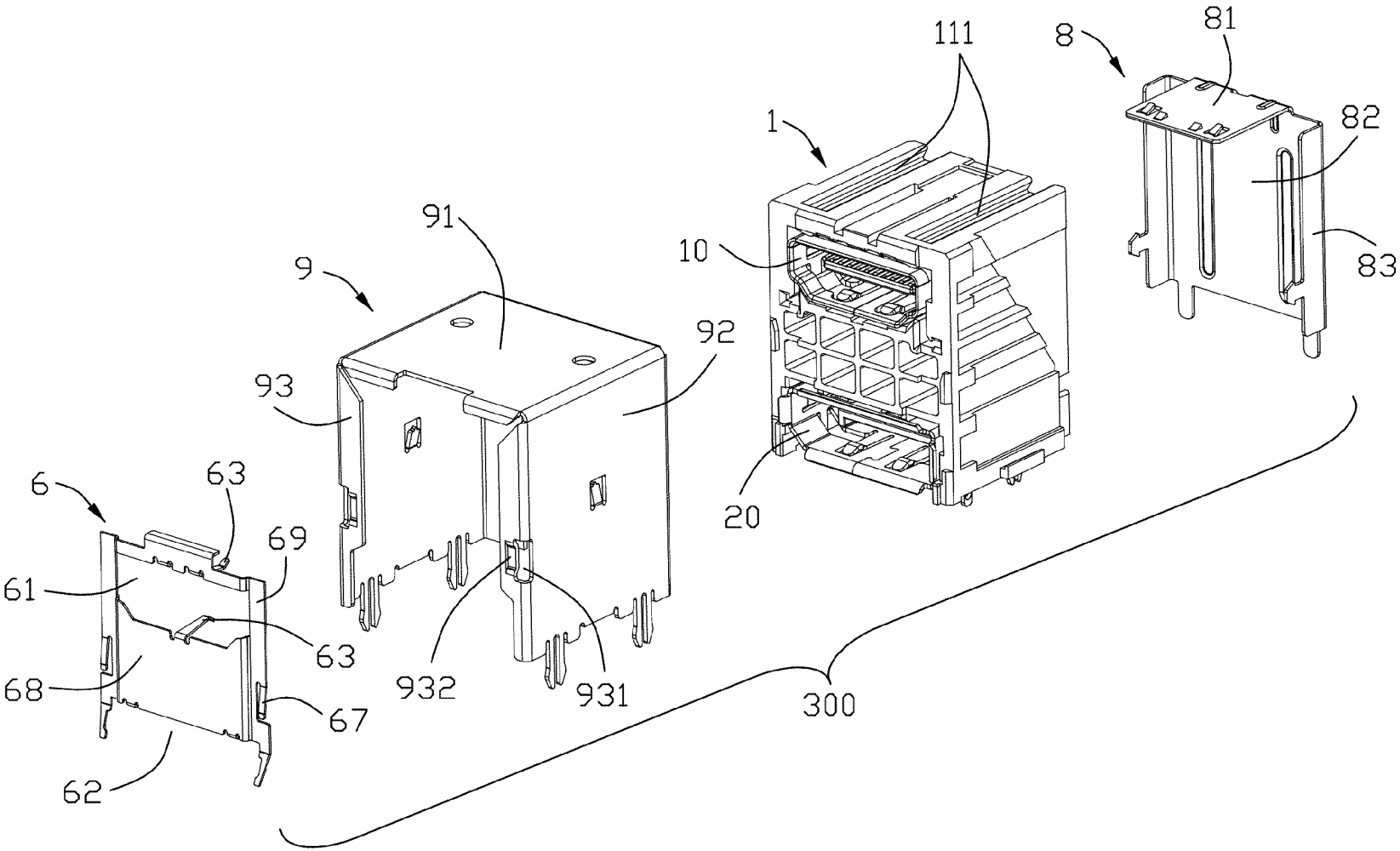
FIG. 15 is a part exploded view of a stacked electrical connector according to a third embodiment of the present invention.

The second insulator 1 includes a top wall 11, a first and a second side portion 12, 13 and a rear surface 18 opposite to the front surface 14. In order to form the second and the third connectors 10, 20, a second and a third receiving spaces 15, 16 are defined through the front surface 14 of the second insulator 1. The second receiving space 15 is located below the top wall 11. The third receiving space 16 is open to the outside through a bottom wall of the second insulator 1. The second insulator 1 further includes an upper tongue 17 extending into the second receiving space 15. The top wall 11 defines a pair of dovetail shaped recesses 111 backwardly extending through the rear surface 18 as best shown in FIG. 7 for easily assembly of the dovetail shaped protrusions 315. The first and the second side portions 12, 13 are both layer shaped and include outer layers 123, 133, inner layers 124, 134 and fracture surfaces separating the outer and inner layers 123, 133 and 124, 134. In detail, the fracture surfaces include slant first fracture surfaces 121, 131 and vertical second fracture surfaces 122, 132. A slit 181 is formed through the rear surface 18 and is located under the top wall 11.

The second connector 10 includes the upper tongue 17 of the second insulator 1, a plurality of second contacts 41 mounted on opposite sides of the upper tongue 17 and an upper metal shell 42 enclosing the upper tongue 17. Each second contact 41 includes a second contact portion 411, a second mounting portion 412 perpendicular to the second contact portion 411 and a second soldering tail 413 at a distal end of the second mounting portion 412. The upper metal shell 42 is received in the second receiving space 15 via out surfaces of the upper metal shell 42 resisting against inner surfaces of the second receiving space 15.

The third connector 20 includes a lower tongue 21 under the upper tongue 17, a plurality of third contacts 22 and a lower metal shell 23 enclosing the lower tongue 21. The lower tongue 21 includes a horizontal section 211 and a pair of vertical sections 212 extending downwardly from lateral sides of the horizontal section 211. In assembly, the third connector 20 is preloaded with the third contacts 22 and the lower metal shell 23 assembled to the lower tongue 21 to form a combination. Thereafter, the preload third connector 20 is received in the third receiving space 16 along a front-to-rear direction.

Then, the second insulator 1 is mounted to the first insulator 31 along the front-to-rear direction with the inner layers 124, 134 of the second insulator 1 received in the receiving opening 314. The first engaging walls 381, 391 abut against the first fracture surfaces 121, 131 and the second engaging walls 382, 392 abut against the second fracture surfaces 122, 132 for positioning purpose. Out surfaces of the side walls 312, 313 are coplanar with the out surfaces of the corresponding outer layers 123, 133 so that an out metal shell 9 can be stably fixed to the out surfaces. Simultaneously, the dovetail shaped protrusions 315 are received in the dovetail shaped recesses 111. Since each dovetail shaped protrusion 315 has an upper narrow section 316 and a lower wide section 317, a movement along a vertical direction is prevented. As a result, the first and the second insulators 31, 1 can be stably fixed with each other. However, it is easy to be understand that the dovetail shaped protrusions 315 and the dovetail shaped recesses 111 can be transposed to be formed on the top wall 11 of the second insulator 1 and the bottom wall 302 of the first connector 31, respectively. The retaining sections 332 of the first contacts 33 are located at an out surface of the rear plate 318 and the second mounting portions 412 of the second contacts 41 are located at an inner surface of the rear plate 318.

In order to organize the second mounting portions 412, a first spacer 51 and a second spacers 52 are provided. The first spacer 51 includes a base 511, a plurality of first and second fastening slots 512, 513 formed on opposite sides of the base 511, and a plurality of protrusions 514 extending forwardly from the base 511 with the first fastening slots 512 located at lateral sides of the protrusions 514. The second spacer 52 includes a horizontal mounting portion 521 and a pressing portion 522 perpendicular to the horizontal mounting portion 521. A plurality of projections 523 are formed on an inner side of the pressing portion 522. In assembly, the first and the second spacers 51, 52 are received in a rear receiving chamber of the second insulator 1 under a condition that the protrusions 514 resist against the innermost second mounting portions 412, and the middle second mounting portions 412 are received in the first fastening slots 512, and the outmost second mounting portions 412 are received in the second fastening slots 513. The second spacer 52 is fixed to the first spacer 51 via the projections 523 received in the second fastening slots 513 for stably resisting the outmost second mounting portions 412. As a result, the second mounting portions 412 can be stably organized.

According to the first embodiment of the present invention, the first connector 30 is a POF connector, the second connector 10 is a HDMI connector and the third connector 20 is a DisplayPort connector. However, in other embodiments, the first, the second and the third connectors 30, 10, 20 can be of other types. Since the first and the second insulators 31, 1 are separated with each other before assembly, any type of connectors based on actual needs can be selected to be formed thereon. As a result, the stacked electrical connector 100 can be easily modified into other type of connector ports with lower cost.

In order to achieve a good grounding performance, an inner metal shell 8 is provided to be assembled to the second insulator 1. The inner metal shell 8 includes a horizontal portion 81 received in the slit 181 of the second insulator 1, a vertical portion 82 bending from the horizontal portion 81 and a pair of forward bending sections 83 attached to the inner layers 124, 134. The vertical portion 82 is arranged covering the pressing portion 522 of the second spacer 52 and the outmost second mounting portions 412. The inner layers 124, 134 are clipped between the bending sections 83 so that the inner metal shell 8 can be stably fixed to the second insulator 1.

The outer metal shell 9 is arranged enclosing the first and the second insulators 31, 1 and includes a top wall 91 attached to the corresponding the first insulator 31 and a pair of side walls 92 extending downwardly from the top wall 91. The side wall 92 and the top wall 91 include front bending portions 93 bending inwardly from corresponding front edges thereof and rear bending portions 94 bending inwardly from corresponding rear edges thereof. Each bending portion 93, 94 defines a through hole 931, 941 and a curved girder 932, 942 communicating with the through hole 931, 941 under a condition that the curved girder 932, 942 is stamped backwardly towards the first and the second insulators 31, 1.

In order to achieve better grounding performance, a stacked electrical connector 200 according to a second embodiment of the present is disclosed as shown in FIGS. 1-5. In the second embodiment, a front metal piece 6 and a rear metal piece 7 are provided for abutting against the out metal shell 9 in order to form a relative larger grounding path. The front metal piece 6 includes a rectangular opening 65, an upper opening 61 under the rectangular opening 65 and a lower opening 62 under the upper opening 61. A unitary section 68 is located between the upper and the lower openings 61, 62 for shielding an exposed insulation section between the second and the third connector 10, 20. A plurality of upper spring arms 63 are bended backwardly from surrounding edges of the upper opening 61. A plurality of lower spring arms 64 are bended backwardly from an edge of the lower opening 62. A pair of front offset portions 69 are stamped rearwardly from lateral sides of the front metal piece 6. In assembly, the front metal piece 6 is attached to the front surface 14 of the second insulator 1 with the frame portion 303 received in the rectangular opening 65. The upper opening 61 configures with the upper metal shell 42 for receiving the upper metal shell 42. The lower metal shell 23 is received in the lower opening 62. The upper and the lower spring arms 63, 64 mechanically abut against the upper and lower metal shells 42, 23, respectively. The front offset portions 69 are positioned at inner sides of the front bending portions 93 and overlap the front bending portions 93 along the front-to-rear direction. The front offset portions 69 define a plurality of front spring tabs 67 abutting against the curved girders 932. Under this condition, out surfaces of the unitary section 68 and the front bending portions 93 are coplanar with each other.

The rear metal piece 7 includes a body portion 71 and a pair of rear offset portions 72 located at opposite lateral sides of the body portion 71. The rear offset portions 72 are positioned at inner sides of the rear bending portions 94 and overlap the rear bending portions 94 along the front-to-rear direction. The rear offset portions 72 define a plurality of rear spring tabs 73 abutting against the curved girders 942. Under this condition, out surfaces of the body portion 71 and the rear bending portions 94 are coplanar with each other.

The first and the second embodiments show stacked electrical connectors 100, 200 both have three ports. However, according to a third embodiment of the present invention discloses a stacked electrical connector 300 having dual ports. The stacked electrical connector 300 is similar to the stacked electrical connector 200 shown in the second embodiment. The stacked electrical connector 300 is simpler than the stacked electrical connector 200 and is easy to be understood. So, detailed description of the stacked electrical connector 300 is omitted herein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A stacked electrical connector comprising:

a first insulator having a vertical rear plate and a first connector extending forwardly from a top side of the rear plate in order to form a receiving opening restricted by the rear plate and a bottom wall of the first connector, the bottom wall having a first retention member; and a second insulator having a second connector located under the first connector, the second insulator comprising a top wall and a pair of side walls, a second retention member being formed on the top wall for mating with the first retention member, each side wall being layer shaped and comprising an outer layer and an inner layer which is contracted compared with the out layer along a transverse direction; wherein the second insulator is assembled to the first insulator along a front-to-rear direction perpendicular to the transverse direction with the inner layers received in the receiving opening; wherein the first retention member is a protrusion or a dovetail shaped recess, and the second retention member is a rest of the protrusion or the dovetail shaped recess under a condition that the protrusion has an upper narrow section and a lower wide section so that, when the protrusion is received in the dovetail shaped recess, a movement between the protrusion and the dovetail shaped recess along a vertical direction can be prevented; wherein the first insulator comprises a pair of side portions extending forwardly from the rear plate with the receiving opening located between the pair of side portions, each side wall of the second insulator comprising a fracture wall separating the outer and the inner layers under a condition that each side portion of the first insulator has a front engaging wall abutting against the fracture wall for positioning purpose; and wherein both the fracture wall and the front engaging wall are oblique, the out layer of the second insulator is coplanar with the corresponding side portion of the first insulator from an exterior view.

2. The stacked electrical connector according to claim 1, wherein the first retention member is the protrusion which protrudes downwardly into the receiving opening and the second retention member is the dovetail shaped recess, the second insulator comprising a rear surface through which the dovetail shaped recess extends.

3. The stacked electrical connector according to claim 1, wherein the first connector comprises a first receiving space, an optical element received in the receiving space, a pivotal door member for shielding the optical element and a plurality of first contacts electrically connecting the optical element.

4. The stacked electrical connector according to claim 3, wherein the first connector comprises a frame portion with the first receiving space defined therethrough under a condition that the frame portion forwardly extends beyond a front surface of the second insulator.

5. The stacked electrical connector according to claim 3, wherein the second connector defines a second receiving space, a tongue integrally formed with the second insulator and horizontally extending into the second receiving space, and a plurality of second contacts with contact portions fixed on the tongue, and wherein the first and the second contacts have first and second vertical potions, respectively, under a condition that the first vertical portions are located at an out surface of the rear plate and the second vertical portions are located at an inner surface of the rear plate.

6. The stacked electrical connector according to claim 5, further comprising an inner metal shell retained in the second insulator, the inner metal shell comprising a horizontal portion fixed to a meal shield of the second connector and a vertical portion directly covering the second vertical portions for EMI protection.

7. The stacked electrical connector according to claim 1, wherein the second insulator defines a third receiving space outwardly and downwardly exposed to the exterior, the stacked electrical connector further comprising a third preload connector received in the third receiving space along the front-to-rear direction.

8. A stacked electrical connector, comprising:

an upper connector port having an upper tongue, a plurality of upper contacts with upper contact engaging sections received in the upper tongue and an upper metal shell enclosing the upper tongue;

a lower connector port having a lower tongue, a plurality of lower contacts with lower contact engaging sections received in the lower tongue and a lower metal shell enclosing the lower tongue;

a front metal piece defining an upper opening to receive the upper metal shell and a unitary section shielding an exposed insulation section between the upper and the lower connector ports, an upper spring arm being bended backwardly from an edge of the upper opening to mechanically abut against the upper metal shell, a lower spring arm being bending backwardly from the unitary section to mechanically abut against the lower metal shell;

an inner metal shell comprising a horizontal section abutting against the upper metal shell and a vertical section covering the upper contacts; and an out metal shell shielding the upper and the lower connector ports, the out metal shell comprising a front inward bending portion mechanically abutting against the front metal piece; and a rear metal piece opposite to the front metal piece, the rear metal piece comprising a body portion and a rear offset portion located at a lateral side of the body portion, the out metal shell comprising a rear inward bending portion opposite to the front inward bending portion under a condition that the rear offset portion is positioned at an inner side of the rear inward bending portion, and wherein the rear inward bending portion comprises a rear curved girder and the rear offset portion has a rear spring tab abutting against the rear curved girder; wherein the rear inward bending portion overlaps the rear offset portion, and the body portion is substantially coplanar with the rear inward bending portion from an exterior view; and wherein the front metal piece comprises a front offset portion located at a lateral side of the unitary section under a condition that the front inward bending portion overlaps the front offset portion, the front inward bending portion comprising a front curved girder and the front offset portion having a front spring tab abutting against the front curved girder.

9. The stacked electrical connector according to claim 8, further comprising an additional connector port over the upper connector port, the additional connector port comprising an additional receiving space, an optical element received in the additional receiving space, a pivotal door member for shielding the optical element and a plurality of additional contacts electrically connecting the optical element, the stacked electrical connector further comprising a first insulator with the additional connector port formed thereon and a second insulator with the upper and the lower connector ports formed thereon, the first insulator further defining a receiving opening located below the additional connector port to partly receive the second insulator.

10. The stacked electrical connector according to claim 9, wherein the first insulator comprises a dovetail shaped protrusion and the second insulator defines a dovetail shaped recess to receive the dovetail shaped protrusion so that a movement between the dovetail shaped protrusion and the dovetail shaped recess along a vertical direction can be prevented.

11. The stacked electrical connector according to claim 9, wherein the additional connector port comprises a frame portion with the additional receiving space defined therethrough under a condition that the frame portion forwardly extends beyond the upper and the lower connector ports, the front metal piece defining a rectangular opening to receive the frame portion.

12. A stacked electrical connector assembly comprising:

a lower insulative housing including opposite front and rear walls, opposite two side walls, and opposite upper and lower walls to commonly define a lower mating port among said walls;

the lower housing further including a mating tongue extending into the lower mating port and defining two opposite upper and lower surfaces thereof;

a first set of lower contacts having a first set of lower contacting sections positioned upon the lower surface, and a first set of lower tail sections positioned on an exterior side of the rear wall;

a first insulative spacer positioned behind and forwardly covering said first set of lower tail sections;

a second set of lower contacts having a second set of lower contacting sections positioned upon the upper surface, and a second set of lower tail sections positioned on an exterior side of said first spacer;

a second insulative spacer positioned behind and forwardly covering said second set of lower tail sections;

a metallic shell covering an exterior side of the second spacer; and an upper insulative housing with an upside down L-shaped cross-section assembled atop the lower housing and behind the metallic shell, wherein a set of upper contacts having a set of upper contacting sections exposed in an upper mating port, and a set of upper tail sections extending along an exterior side of a rear wall of the upper housing; wherein interengaging structures are formed on both an upper face of the lower housing and a lower face of the upper housing so as to only allow assembling between the upper housing and the lower housing along a front-to-back direction without possibility of withdrawal from each other in a vertical direction perpendicular to said front-to-back direction; and wherein each of said second spacer and said metallic shell defines an L-shaped configuration in a side view.

* * * * *